US008459217B2

(12) United States Patent
Ogura et al.

(10) Patent No.: US 8,459,217 B2
(45) Date of Patent: Jun. 11, 2013

(54) SCAVENGING COVER AND TWO-CYCLE ENGINE

(75) Inventors: Nobuo Ogura, Kawagoe (JP); Hiroyuki Noda, Kawagoe (JP)

(73) Assignee: Husqvarna Zenoah Co., Ltd., Saitama (JP)

( * ) Notice: Subject to any disclaimer, the term of this patent is extended or adjusted under 35 U.S.C. 154(b) by 443 days.

(21) Appl. No.: 12/747,325

(22) PCT Filed: Dec. 11, 2008

(86) PCT No.: PCT/JP2008/073025

§ 371 (c)(1),
(2), (4) Date: Jun. 10, 2010

(87) PCT Pub. No.: WO2009/078452

PCT Pub. Date: Jun. 25, 2009

(65) Prior Publication Data

US 2010/0288251 A1 Nov. 18, 2010

(30) Foreign Application Priority Data

Dec. 14, 2007 (JP) ..... 2007-323849

(51) Int. Cl.
*F02B 25/00* (2006.01)

(52) U.S. Cl.
USPC ..... 123/73 PP; 123/65 P

(58) Field of Classification Search
USPC ..... 123/65 A, 65 P, 65 V, 73 R, 73 A, 123/73 PP, 73 V
See application file for complete search history.

(56) References Cited

U.S. PATENT DOCUMENTS

| | | | | |
|---|---|---|---|---|
| 6,640,755 | B2 | 11/2003 | Araki | |
| 6,662,765 | B2 | 12/2003 | Araki | |
| 7,520,253 | B2 * | 4/2009 | Mochizuka et al. | 123/73 PP |
| 2002/0104493 | A1 | 8/2002 | Fukuoka et al. | |

FOREIGN PATENT DOCUMENTS

| | | | |
|---|---|---|---|
| JP | 60-153428 | A | 8/1985 |
| JP | 62-243946 | A | 10/1987 |
| JP | 2002-227652 | A | 8/2002 |
| JP | 2002-227653 | A | 8/2002 |
| JP | 2002-276377 | A | 9/2002 |

(Continued)

OTHER PUBLICATIONS

International Search Report dated Jan. 27, 2009 issued in International Appln. No. PCT/JP2008/073025.
Japanese Office Action dated Nov. 29, 2011 (and English translation thereof) in counterpart Japanese Application No. 2007-323849.
International Preliminary Report on Patentability (PCT Chapter I) dated Jun. 15, 2010 (in English) issued in counterpart International Application No. PCT/JP2008/073025.

*Primary Examiner* — Noah Kamen
(74) *Attorney, Agent, or Firm* — Holtz, Holtz, Goodman & Chick, P.C.

(57) ABSTRACT

Since a throttle hole for narrowing a scavenging passage is provided on a partition for closing the scavenging passage, the throttle hole of a desired size can be drilled at a desired location on the partition after preparing the scavenging cover having no throttle hole on the partition. Accordingly, the size and location of the throttle hole can be easily changed in conducting a test for finding the most appropriate size and location of the throttle hole, so that the most appropriate size and location of the throttle hole can be easily found.

5 Claims, 6 Drawing Sheets

FOREIGN PATENT DOCUMENTS

| | | | |
|---|---|---|---|
| JP | 2003-293774 | A | 10/2003 |
| JP | 2005-009462 | A | 1/2005 |
| JP | 2007-077942 | A | 3/2007 |
| JP | 2007-170294 | A | 7/2007 |
| JP | 2007-177774 | A | 7/2007 |
| JP | 2007-229595 | A | 9/2007 |
| JP | 2008-121461 | A | 5/2008 |
| JP | 2008-138602 | A | 6/2008 |

* cited by examiner

SCAVENGING COVER AND TWO-CYCLE ENGINE

This application is a U.S. National Phase Application under 35 USC 371 of International Application PCT/JP2008/073025 filed Dec. 11, 2008.

TECHNICAL FIELD

The present invention relates to a scavenging cover and a two-cycle engine.

BACKGROUND ART

A traditionally known two-cycle engine includes: a scavenging passage that includes a main passage provided near an exhaust port for combustion gas and a sub passage provided near an intake port of air-fuel mixture; and a throttle provided on the sub passage (see Document 1: JP-A-60-153428, for instance). The provision of the throttle on the sub passage of the two-cycle engine allows flow speed control in the sub passage by changing the size of the throttle, thus restraining blow-by of the air-fuel mixture during the scavenging process.

Since blow-by-restraining effect of the air-fuel mixture is greatly influenced by subtle flow speed change in the sub-passage of the two-cycle engine, the most appropriate size of the throttle is normally found by testing with various sizes of the throttle in order to control the flow speed in the sub-passage when the engine is manufactured.

However, since the throttle of the scavenging passage is provided by a thick portion of the cylinder wall or the thick portion of the crankcase, in order to vary the size of the throttle, the whole cylinder or the crankcase has to be reproduced while varying the thickness at the thick portion, which takes a lot of work and consequently makes it difficult to easily find the most appropriate value of the size of the throttle.

DISCLOSURE OF INVENTION

An object of the invention is to provide a scavenging cover and a two-cycle engine capable of easily finding the most appropriate value of the size of the throttle provided in the sub passage.

A scavenging cover according to an aspect of the invention provides a part of a scavenging passage including a main passage provided near an exhaust port of a two-cycle engine and a sub passage provided near an intake port, the scavenging cover including: a partition that closes the sub passage, the partition being provided with a throttle hole.

According to the above aspect of the invention, since the throttle hole for narrowing the scavenging passage is provided on the partition for closing the scavenging passage, the throttle hole of a desired size can easily be drilled at a desired location on the partition after preparing the scavenging cover having no throttle hole on the partition. Accordingly, the size and location of the throttle hole can be easily changed in conducting a test for finding the most appropriate size and location of the throttle hole, the most appropriate size and location of the throttle hole can be easily found.

In the scavenging cover according to the above aspect of the invention, it is preferable that the throttle hole includes: a first throttle hole provided near the exhaust port; and a second throttle hole provided near the intake port and having smaller diameter than the first throttle hole.

According to the above arrangement, since the combination of the location and size of the throttle hole can be favorably determined, so that the blow-by (the air-fuel mixture is exhausted without being burnt) during the scavenging process can be more efficiently restrained.

In the scavenging cover of the present invention, it is preferable that an opposed face opposing to the intake port, the throttle hole provided on the partition near the opposed face.

According to the above arrangement, since the throttle hole can be located at a more appropriate position, the flow direction of the air-fuel mixture can be favorably controlled, thereby further efficiently restraining the blow-by.

In the scavenging cover of the above aspect of the invention, it is preferable that the throttle hole is triangular or quadrangular in plan view.

According to the above arrangement, since the throttle hole is triangular or quadrangular in plan view, the shape of the throttle hole can be simplified and the scavenging cover can be easily produced.

A two-cycle engine according to another aspect of the invention includes the above-described scavenging cover of the invention.

According to the above aspect of the invention, since the same scavenging cover as the above is provided, the same advantages as the above can be obtained.

BEST MODE FOR CARRYING OUT THE INVENTION

An embodiment of the invention will be described below with reference to attached drawings.

Figure 1:
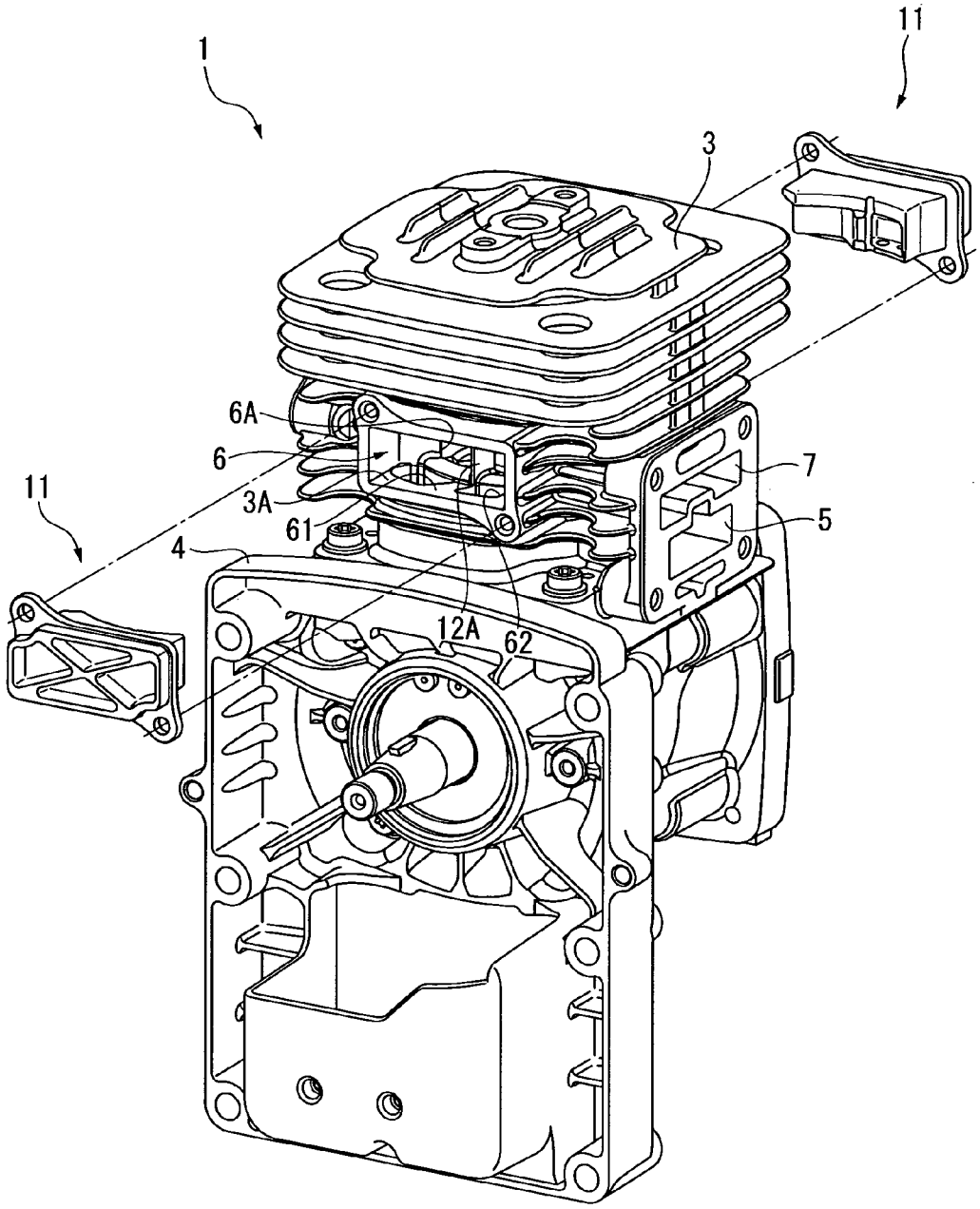
FIG. 1 is a perspective view showing a stratified scavenging two-cycle engine according to an embodiment of the invention.
Figure 2:
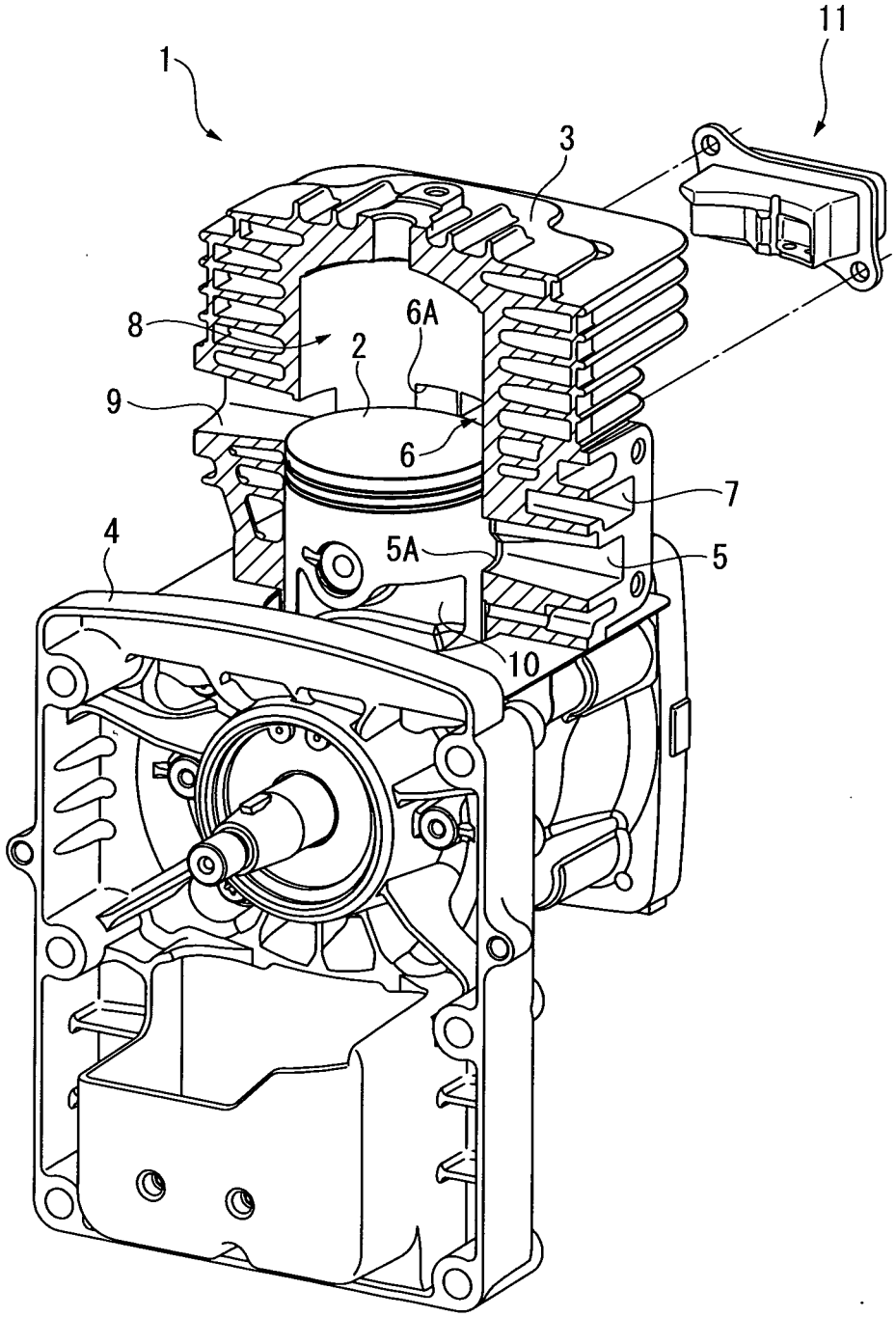
FIG. 2 is a perspective view showing the engine with a part thereof being cut away.

FIG. 1 is a perspective view of a stratified scavenging two-cycle engine (simply referred to as engine hereinafter) according to the embodiment. FIG. 2 is a perspective view showing a part of the engine 1 being cut away.

In the engine 1 shown in FIGS. 1 and 2, an intake passage 5 for feeding air-fuel mixture into a crankcase 4 and a leading-air passage 7 for feeding leading air into a pair of scavenging passages 6 are provided on a lateral side of a cylinder 3. An exhaust passage 9 (FIG. 2) is provided on a side opposite to the passages 5, 7 with a combustion chamber 8 interposed therebetween.

The intake passage 5 includes an intake port 5A (FIG. 2) that is opened and closed in accordance with vertical movement (in the figure) of a piston 2, through which the air-fuel mixture is fed into the crankcase 4 when the piston 2 is upwardly moved. A pair of recesses 10 for intercommunicating the leading-air passage 7 with the scavenging passage 6 when the piston 2 is moved upward are provided on the outer circumference of the piston 2. The leading-air passage 7 feeds the leading air to an upper side in the scavenging passage 6 through the recesses 10 when the piston 2 is moved upward.

In the engine 1, when a scavenging port 6A is opened to the combustion chamber 8 in accordance with downward movement of the piston 2, the air-fuel mixture fed into the crankcase 4 is transferred to the combustion chamber 8 through the scavenging passage 6 to scavenge the combustion gas. At this time, since the leading air is filled in the upper side in the scavenging passage 6 in the engine 1 of the embodiment, the leading air is preliminarily initially fed into the combustion chamber 8 to scavenge the combustion gas to be blown by (i.e. flows toward the exhaust passage 9). Accordingly, blow-by of the air-fuel mixture can be restrained for the amount of the blown-by leading air in the present embodiment, thus reducing the discharge of THC (hydrocarbon).

Incidentally, the scavenging passage 6 is provided at two locations on the cylinder 3 to be displaced approximately by 90 degrees relative to the intake passage 5 and the exhaust passage 9 to be opened on the inner circumference of the cylinder 3 as scavenging ports 6A. A part of the passage is constructed by: core holes (see FIG. 1) 3A provided on the cylinder 3 to form the scavenging port 6A; and scavenging covers 11 fitted into the holes 3A.

Figure 3:
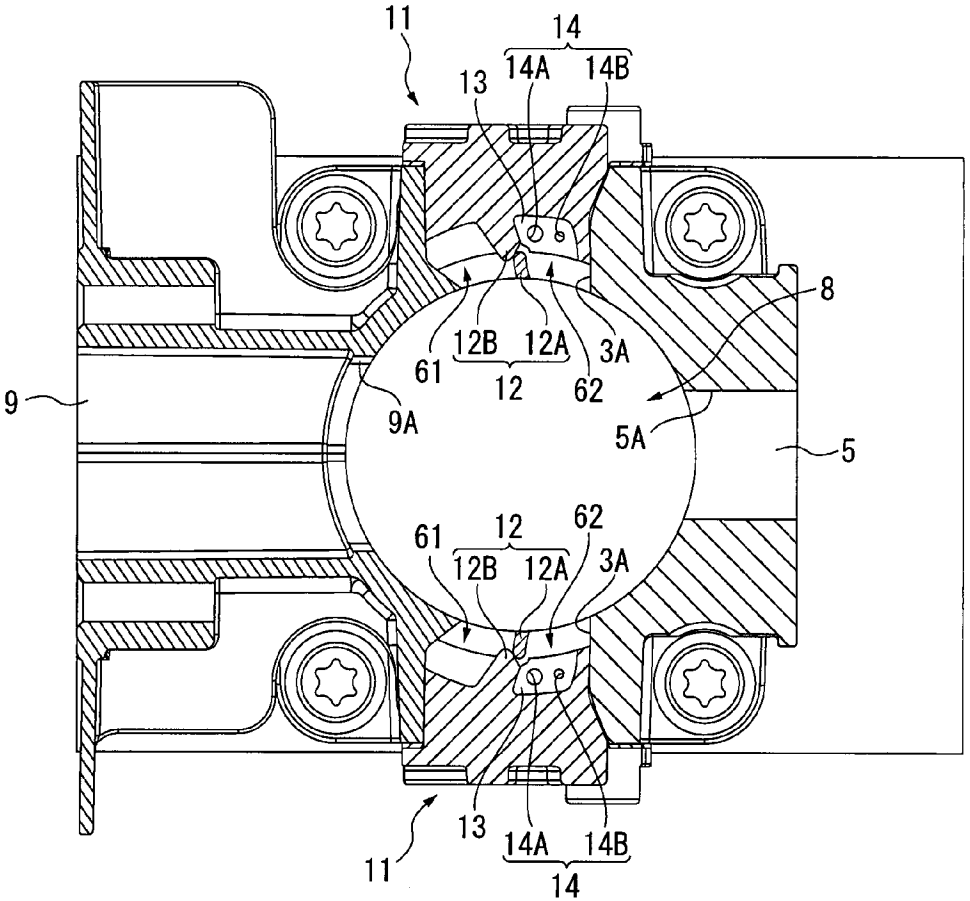
FIG. 3 is a horizontal cross sectional view of a cylinder for showing a scavenging passage and a scavenging cover.

FIG. 3 is a horizontal cross sectional view of the cylinder 3 for showing the scavenging passage 6 and the scavenging cover 11.

Such scavenging passage 6 is divided into a main passage 61 provided near an exhaust port 9A and a sub passage 62 provided near the intake port 5A by a scavenging passage partition 12 including a hole-side scavenging passage partition 12A provided within the hole 3A and a cover-side scavenging passage partition 12B provided on the scavenging cover 11. The main passage 61 and the sub passage 62 are formed in a shape that introduces the leading air and the air-fuel mixture into the combustion chamber 8 approximately in a tangential direction.

In the main passage 61 and the sub passage 62, the passage area of the sub passage 62 is narrowed relative to the main passage 61, so that air-fuel mixture with large flow speed can be fed into the combustion chamber 8. Accordingly, the leading air and the air-fuel mixture with different flow speed and direction can be fed into the combustion chamber 8 through the main passage 61 and the sub passage 62 in the present embodiment, so that blow-by of the air-fuel mixture can be restrained.

Figure 4:
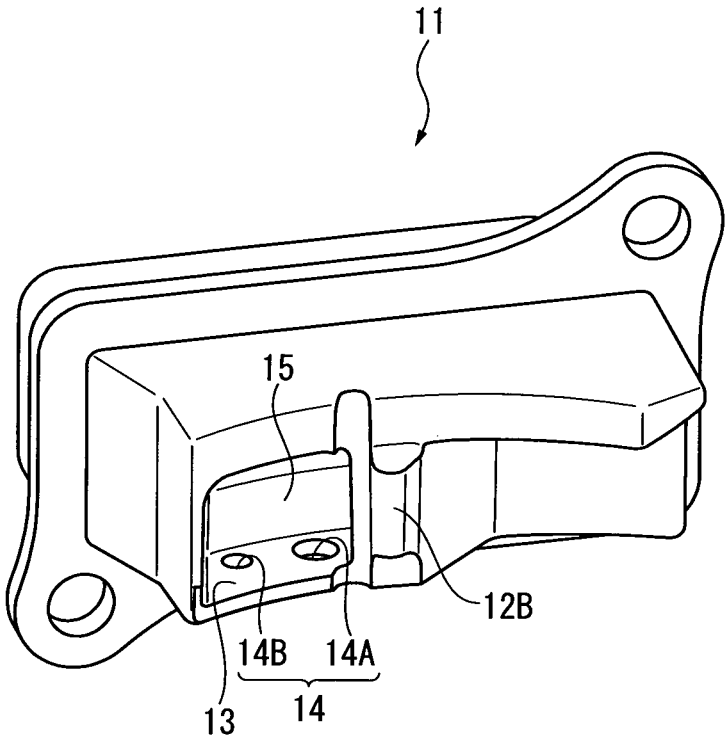
FIG. 4 is an enlarged illustration of the scavenging cover.

FIG. 4 is an enlarged illustration of the scavenging cover.

In the present embodiment, the cover 11 is provided with a partition plate (partition) 13 for closing the sub passage 62. Throttle holes 14 for further throttling the sub passage 62 is provided on the partition plate 13. Accordingly, leading air and air-fuel mixture that is controlled to have the most appropriate flow speed can be fed from the sub passage 62 into the combustion chamber 8 in the present embodiment, thus securely restraining the blow-by of the air-fuel mixture and significantly reducing the discharge of THC.

Since the throttle holes 14 is provided on the partition plate 13, by preparing the scavenging cover 11 without forming the throttle hole 14 on the partition plate 13, the throttle hole 14 of appropriate size can be drilled at desired position on the partition plate 13 in conducting the test for finding the most appropriate size and location of the throttle hole 14. Accordingly, as compared with conventional arrangement in which a whole cylinder is prepared for each test, the test can be easily conducted, so that the most appropriate size and location of the throttle hole 14 can be easily found. Incidentally, in commercialization of the engine, the throttle hole 14 is molded in advance on the partition plate 13 with the most appropriate size and location determined by conducting the test.

Such throttle hole 14 is provided on the partition plate 13 near a face 15 of the cover 11 opposed to the intake port 5A. Accordingly, flow-in resistance of the air-fuel mixture flowing along the wall of the sub passage 62 toward the throttle hole 14 can be reduced, and flow direction of the air-fuel mixture and the leading air can be controlled in a preferable direction.

In the present embodiment, as shown in FIGS. 3 and 4, the throttle hole 14 includes: a circular first throttle hole 14A (3 mm diameter) provided near the exhaust port 9A; and a circular second throttle hole 14B (2 mm diameter) provided near the intake port 5A. Accordingly, while reducing discharge of THC, a desired level of output can be secured in the present embodiment.

Figure 5:
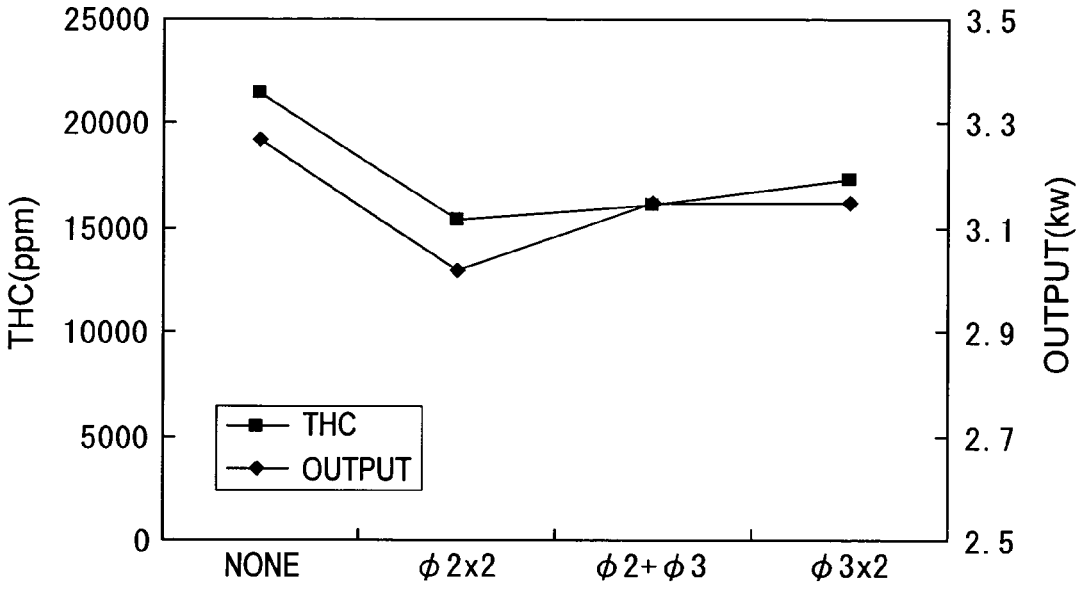
FIG. 5 is a graph for illustrating an effect of the invention.

FIG. 5 is a graph showing a measurement result of discharge amount of THC and output of the engine, comparing the arrangements: provided with no partition plate 13; provided with two throttle holes of 2 mm diameter on the partition plate 13 ($\phi 2 \times 2$); provided with throttle holes of 2 mm diameter and 3 mm diameter on the partition plate 13 ($\phi 2 + \phi 3$); and provided with two throttle holes of 3 mm diameter on the partition plate 13 ($\phi 3 \times 2$).

As shown in FIG. 5, the results of the measurement revealed that, when two throttle holes of 2 mm diameter were provided on the partition plate 13, the output was reduced though the discharge amount of THC was restrained at the lowest level. Accordingly, it is confirmed that provision of throttle holes of 2 mm diameter and 3 mm diameter on the partition plate 13 provides the best balance between the discharge amount of THC and the output.

Modification of Embodiment

Incidentally, the scope of the present invention is not limited to the above embodiments, but includes modification and improvements as long as an object of the invention can be achieved.

For instance, though the engine 1 of the above embodiment is a stratified scavenging two-cycle engine, the invention may be applied to a normal (i.e. not stratified scavenging) two-cycle engine.

Though only a single sub passage is provided in the above embodiment, a plurality of sub passages may be provided.

Figure 6:
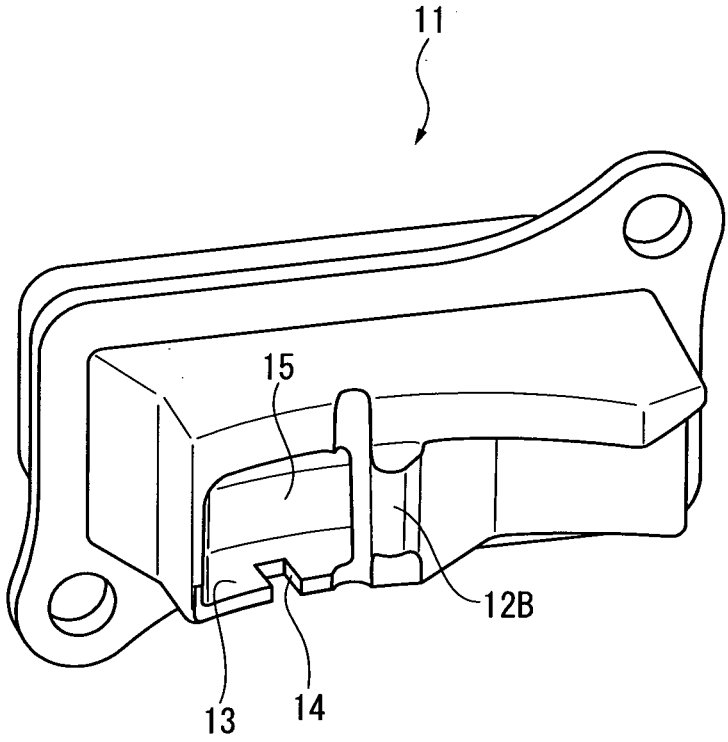
FIG. 6 is an enlarged illustration of a scavenging cover according to a modification of the invention.

Though two throttle holes 14 are provided in the above embodiment, only a single throttle hole 14 may be provided or, alternatively, more than two throttle holes may be provided. The shape of the throttle hole may not be circular in plan view. For instance, the throttle hole may be provided as a notch as shown in FIG. 6, or may be configured in any shape in plan view such as a triangle and quadrangle.

Though the partition plate 13 is provided as a plate in the above embodiment, the partition plate may not be a plate but is only required to close the sub passage 62.

The invention claimed is:

1. A scavenging cover that is configured to provide a part of a scavenging passage including a main passage and a sub passage, the main passage being provided nearer to an exhaust port of a two-cycle engine than the sub passage is, and the sub passage being provided nearer to an intake port of the two-cycle engine than the main passage is, the scavenging cover comprising:

a partition that closes the sub passage, wherein the partition is provided with a first throttle hole and a second throttle hole, the first throttle hole being provided nearer to the exhaust port than the second throttle hole is, and the second throttle hole being provided nearer to the intake port than the first throttle hole is, and the second throttle hole being smaller than the first throttle hole.

2. The scavenging cover according to claim 1, wherein the scavenging cover comprises an opposed face that is opposed to the intake port, and the throttle holes are provided to the partition near the opposed face.

3. The scavenging cover according to claim 1, wherein at least one of the throttle holes is triangular or quadrangular in plan view.

4. The scavenging cover according to claim 1, wherein at least one of the throttle holes is circular in plan view.

5. A two-cycle engine, comprising:

the scavenging cover according to claim 1.

* * * * *